US011562613B2

(12) United States Patent
Arnold et al.

(10) Patent No.: US 11,562,613 B2
(45) Date of Patent: Jan. 24, 2023

(54) CONTAINER DEPOSIT RETURN SYSTEM

(71) Applicant: Nessie Solutions, LLC, Spring Lake, MI (US)

(72) Inventors: Nathan Arnold, Spring Lake, MI (US); Foster Hovey, Lowell, MI (US); Nick Tonar, Holland, MI (US); John Santose, Grand Rapids, MI (US); Matthew Reed, Ann Arbor, MI (US); Andrew Westrick, South Lyon, MI (US); Constantine Fanourakis, Zeeland, MI (US); Olek Berezecky, Zeeland, MI (US); Joe Brophy, Zeeland, MI (US)

(73) Assignee: NESSIE SOLUTIONS, LLC, Spring Lake, MI (US)

( * ) Notice: Subject to any disclaimer, the term of this patent is extended or adjusted under 35 U.S.C. 154(b) by 0 days.

(21) Appl. No.: 17/082,936

(22) Filed: Oct. 28, 2020

(65) Prior Publication Data

US 2021/0217265 A1 Jul. 15, 2021

Related U.S. Application Data

(60) Provisional application No. 62/927,089, filed on Oct. 28, 2019.

(51) Int. Cl.

| | |
|---|---|
| ***G07F 7/06*** | (2006.01) |
| ***G07F 7/00*** | (2006.01) |
| ***B30B 9/32*** | (2006.01) |

(52) U.S. Cl.

CPC ..... *G07F 7/0609* (2013.01); *B30B 9/321* (2013.01); *G07F 7/005* (2013.01)

(58) Field of Classification Search

CPC ..... G07F 7/06; G07F 7/09609; G07F 7/005; G30B 9/321

See application file for complete search history.

(56) References Cited

U.S. PATENT DOCUMENTS

| | | | | |
|---|---|---|---|---|
| 4,345,679 | A * | 8/1982 | DeWoolfson | B30B 9/325 100/902 |
| 5,361,913 | A * | 11/1994 | Melchionna | G07F 7/0609 209/583 |
| 9,272,842 | B1 * | 3/2016 | Torres-Muniz | B30B 9/321 |
| 11,017,049 | B2 * | 5/2021 | Flood | G06K 7/10316 |
| 2010/0301148 | A1 * | 12/2010 | Arnone | B02C 19/0087 241/99 |

(Continued)

*Primary Examiner* — Thien M Le
*Assistant Examiner* — Asifa Habib
(74) *Attorney, Agent, or Firm* — The Watson IP Group, PLC; Jovan N. Jovanovic

(57) ABSTRACT

A container deposit return system having a housing, a crushing assembly and a control system. The crushing assembly is positioned within the housing and has a first crushing wall and a second crushing wall spaced apart from the first crushing wall defining a crush cavity, and, a crushing wall movement assembly structurally configured to move the first crushing wall relative to the second crushing wall to direct the first crushing wall toward and away from the second crushing wall. The two crushing walls are configured crush a container that is positioned within the crush cavity. The control system having at least one imaging sensor, the imaging sensor configured to record an image the container before crushing and after crushing.

18 Claims, 14 Drawing Sheets

(56) References Cited

U.S. PATENT DOCUMENTS

| | | | | |
|---|---|---|---|---|
| 2011/0019023 | A1* | 1/2011 | Muramatsu | H04N 5/23229 348/222.1 |
| 2011/0186623 | A1* | 8/2011 | Truesdale | G07F 7/06 235/375 |
| 2018/0056617 | A1* | 3/2018 | Chan | B30B 9/3021 |
| 2018/0232745 | A1* | 8/2018 | Saether | G06Q 20/4016 |
| 2019/0374977 | A1* | 12/2019 | Martinsen | B07C 5/36 |

* cited by examiner

CONTAINER DEPOSIT RETURN SYSTEM

CROSS-REFERENCE TO RELATED APPLICATION

This application claims priority from U.S. Pat. App. Ser. No. 62/927,089 entitled "CONTAINER DEPOSIT RETURN SYSTEM" filed Oct. 28, 2019, the entire disclosure of which is hereby incorporated by reference in its entirety.

BACKGROUND OF THE DISCLOSURE

1. Field of the Disclosure

The disclosure relates in general to recycling systems, and more particularly, to a can and bottle deposit return system. It is contemplated that such a can and bottle deposit return system is positioned within a consumers home, office or other location, and that the system can communicate with retailers to accomplish at remote deposit recovery by a consumer for recyclable containers for which a deposit has been paid.

2. Background Art

In an effort to foster recycling and to deter littering, many state and local governments have imposed a deposit system for drink containers (typically bottles and cans). For example, and with some exceptions, the State of Michigan has a $0.10 deposit that is paid when a beverage is purchased that is in a can or bottle. That is, the distributor charges the retailer a deposit, and that deposit is then charged to the consumer. When the consumer returns the bottle, the deposit is returned to the consumer by the retailer, and then by the distributor to the retailer.

To handle the volume of returned containers (and to minimize instances of fraud), retailers have set up elaborate and complicated systems for the return of these containers. In many retail locations, specialized equipment is provided in a certain location of the store wherein the consumer brings in the empty cans and runs the cans through a can return machine. The can return machine first identifies the container as being eligible and then processes the container (typically destroying the container) and then provides the deposit to the consumer.

Problematically, such systems and equipment are expensive to both procure and also to manage, operate and maintain. Thus, there is a net loss for the retailer of operating such a system. On the other hand, the consumer likewise is required to return the empty can to the retailer and to process each container at the equipment. In some instances, the equipment does not recognize the container, in other instances, the equipment can fail. Generally, it is not a pleasant experience to collect the return deposits from empty containers.

SUMMARY OF THE DISCLOSURE

The disclosure is directed to a container deposit return system having a housing, a crushing assembly and a control system. The crushing assembly is positioned within the housing. The crushing assembly has a first crushing wall and a second crushing wall spaced apart from the first crushing wall defining a crush cavity, and, a crushing wall movement assembly structurally configured to move the first crushing wall relative to the second crushing wall to direct the first crushing wall toward and away from the second crushing wall, to, in turn, crush a container positioned within the crush cavity. The control system has at least one imaging sensor. The imaging sensor is configured to record an image the container before crushing and after crushing.

In some configurations, the control system further includes a can identifying sensor structurally configured to identify the can through a bar code on the can.

In some configurations, the first crushing wall further includes an inner side having a centering surface which is structurally configured to center the can thereon.

In some configurations, the centering surface further includes a central region, a first side incline positioned to one side of the central region and a second side incline positioned to a second side of the central region. The first and second inclined portions extend away from the central region and also toward the second crushing wall.

In some configurations, the second crushing wall further comprises a puncture assembly. The puncture assembly has a plurality of pins extendable through a plurality of openings in the second crushing wall and a biasing member biasing the pins relative to the second crushing wall. Once the biasing member is overcome, the plurality of pins extend through the plurality of openings.

In some configurations, the crush cavity is defined by the first crushing wall and the second crushing wall, a first side containing wall and a second side containing wall positioned opposite the first side containing wall. The first side and second side containing walls span between the first crushing wall and the second crushing wall. A top wall assembly is movable from a first open position to a second closed position. A bottom wall is movable from a first retain position to a second disposal position.

In some configurations, the imaging sensor is configured to record an image of the crushing cavity before and after crushing a can while the top wall assembly remains in a second closed position and the bottom wall remains in a first retain position.

In some configurations, the crushing wall movement assembly comprises a linear actuator including at least one lead screw assembly and a motor rotatably coupled to the lead screw assembly.

In some such configurations, the at least one lead screw assembly further includes a lead screw having a first end and a second end. The first end is rotatably coupled to the motor, and rotatably coupled to one of the frame and the second crushing wall. A lead nut is fixedly coupled to the first crushing wall with the lead screw extending through the lead nut. Rotation of the lead screw interfacing with the lead nut translates the first crushing wall one of toward and away from the second crushing wall.

In some configurations, the at least one lead screw assembly comprises two lead screw assemblies, each positioned on opposing sides of the first crushing wall.

In some configurations, at least one of the first crushing wall and the second crushing wall includes an inclined lip at the lower end thereof.

In some configurations, the housing further comprises a frame having a base and a back wall upstanding from the base, and, a cover. The cover has a top, a front, a first side and a second side. The frame and the cover cooperatively define an inner cavity. The crushing assembly is positioned within the inner cavity. The top of the cover includes an access opening providing access to the crush cavity.

In some configurations, the system further includes a housing mount system. In some configurations, the housing mount system further comprises a floor stand having a receiving platform, and a plurality of legs depending therefrom, collectively defining a lower cavity configured to receive a recycling tote.

In some configurations, the housing mount system further comprises a wall mount plate that is releasably securable to an outside wall and releasably securable to the housing to facilitate the mounting thereof to the outside wall.

In another aspect of the disclosure, the disclosure is directed to a method of refunding a deposit on a container comprising the steps of: providing a container deposit return system described herein; establishing communication between a server and the can deposit return system; receiving at the server an identification of the type of a container introduced into the container deposit return system; receiving at the server an image of a container before crushing and an image of the container after crushing; determining a match between the identification of the type of container and the image of the container before crushing and the image of the container after crushing; and refunding the deposit on the container if the step of determining determines a match.

In some configurations, the method further includes the step of transmitting to the container deposit return system the identifications of acceptable ones of a type of container.

In another aspect of the disclosure, the disclosure is directed to a method of utilizing a container deposit return system comprising the steps of: providing a container deposit return system disclosed herein; placing the control system into communication with a server; introducing a container into the crush cavity of the container deposit return system; taking a first image of the container within the crush cavity prior to crushing of the container; taking a second image of the container within the crush cavity after crushing of the container; transmitting the first image and the second image to the server; and removing the container from the crush cavity.

In some configurations, the method includes the steps of obtaining an identification of the container prior to taking the first image of the container; comparing the identification of the container with a listing of known identifications to determine a match; and identifying one of a match and a no match to the user.

In some configurations, the method includes the step of locking the crush cavity after the step of introducing and prior to the step of taking the first image.

BRIEF DESCRIPTION OF THE DRAWINGS

The disclosure will now be described with reference to the drawings wherein.

DETAILED DESCRIPTION OF THE DISCLOSURE

Figure 1:
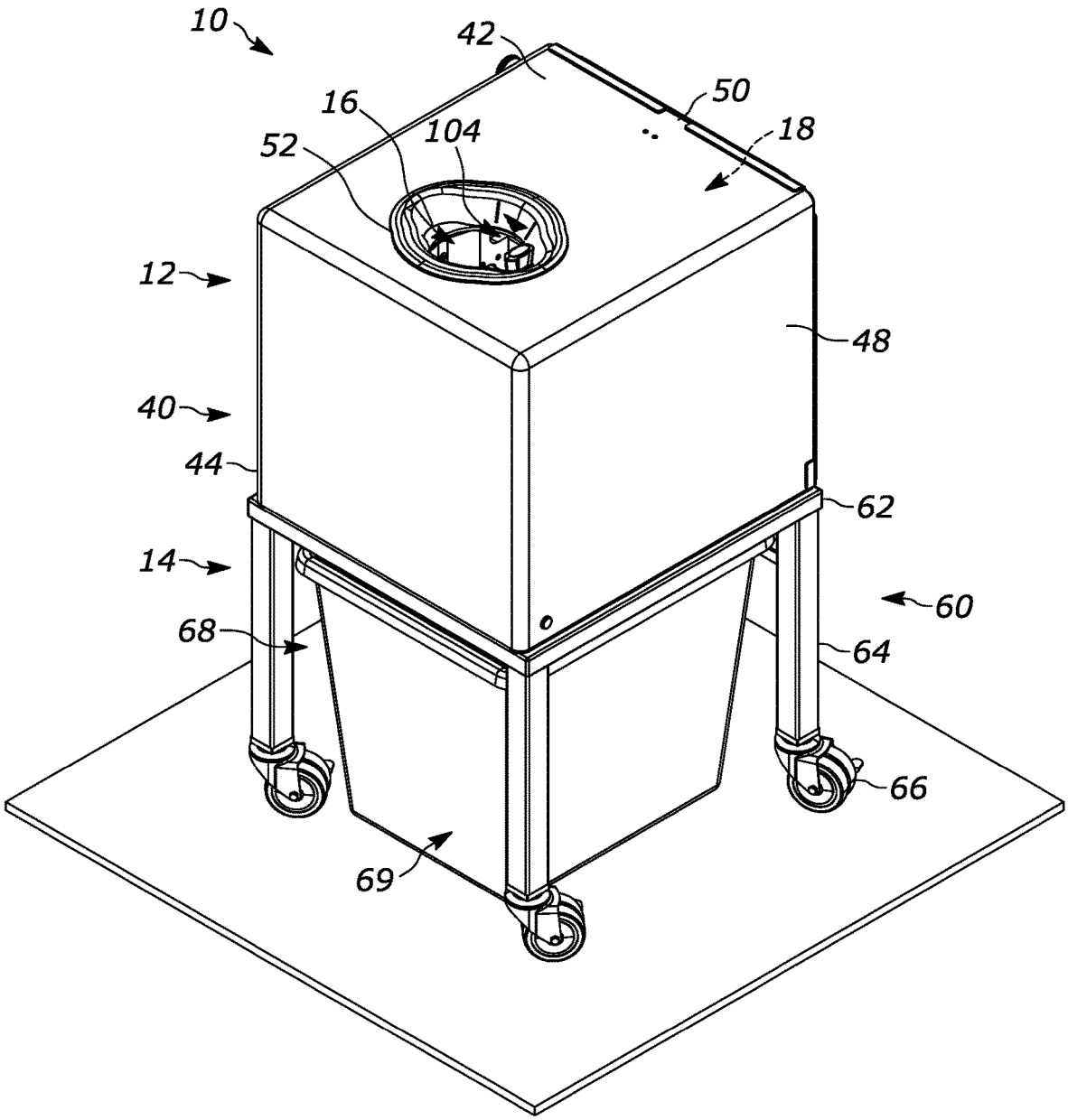
FIG. 1 of the drawings is a perspective view of a configuration of the container deposit return system of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the container deposit return system is shown generally at 10. The container deposit return system includes housing 12, housing mount 14, crushing assembly 16 and control system 18. It is contemplated that the deposit return system is positioned in a home of a consumer (or office or other location remote from the retailer). For example, a user can maintain one such system in a kitchen, pantry, utility room or garage, among other locations. Preferably, the system is positioned at a location that includes an outlet for power (while other systems may include rechargeable batteries which require only selective coupling to power outlets or the like).

It will be understood that the system is generally configured for use in association with the types of containers for which a deposit is required. Such containers include, but are not limited to, polymer based beverage containers (including, but not limited to 2 liter bottles, 16 ounce bottles, one liter bottles, etc.) as well as beverages in cans (carbonated beverages, beer, energy drinks, etc.). In the present configuration, both metal and polymer based cans are contemplated as functioning within the system as currently provisioned. An exemplary bottle is shown at 102 in the drawings.

The housing 12 is shown in FIGS. 1, 2, 4 and 5 as comprising frame 20, cover 40 and coupling 54 that facilitates the coupling of the cover 40 to the frame 20. The frame generally comprises a structure formed of metal members (while composites and polymers are likewise contemplated) that includes base 22 and a plurality of upstanding walls defining an inner cavity 36. The base 22 includes an opening that corresponds to the bottom wall (which is described below) so as to permit crushed cans and bottles to exit from the system. In the configuration shown, the upstanding walls include back wall 24, first sidewall 26 and second sidewall 28, and front wall 29. The back wall is opposite the front wall with the sidewalls spanning therebetween on opposite sides of each other. The back wall includes upper lip 30, side guides 32 and a plurality of slots 34 defined in the back wall. In the configuration shown, the sidewalls comprise generally triangular members having a relatively large triangular opening, to, in turn, define a frame wall. The front wall comprises a relatively short lip that is upstanding from the front of the base.

In the configuration shown, the frame defines a generally a square cubic inner cavity 36, while the back wall is of a full height, with the front wall being of a short, lip-like configuration, and with the side walls forming a triangular or angled configuration from the back wall to the front wall. Such a configuration allows for a sturdy frame, while permitting increased access to the inner cavity. A number of variations are contemplated including frames of different base configurations and upstanding wall configurations (i.e., cylindrical or column like with a polygonal base, for example, conical, frustoconical, rectangular, trapeziodal, among others).

The cover 40 is shown as comprising top 42, front 44, first side 46 and second side 48. The cover generally matches the configuration of the frame to form a square cubic configuration. In the configuration shown, the top includes a back edge 50 that engages the upper lip 30 of the back wall 24. Additionally, the top includes an access opening, which provides access into the housing 12 to, in turn, pass a can into the crush cavity 17 (which will be described hereinbelow). The first side 46 overlies the first side wall 26 and second side 48 overlies the second sidewall 28. The side guides 32 of the back wall 24 of the frame in cooperation with the respective one of the first side wall and the second side wall sandwiches the respective one of the first side and the second side of the cover therebetween.

The cover is maintained in the installed configuration through coupling 54. The coupling 54 comprises an outwardly biased spring mounted tab (or button) on each of the first side wall and second side wall. The button is positioned so that when the cover is properly installed, the tab outwardly moves into a corresponding openings on each one of the first side and the second side, capturing the cover and precluding decoupling therefrom. To remove the cover, the user can push the outwardly biased tabs inwardly until they fully exit the openings in the cover. At such time, the cover can be rotated about the back edge of the top and the upper lip of the back wall. Once rotated to clear the side guides 32, the cover can be pulled away therefrom and separated from the frame.

In other configurations, the cover can be installed and maintained with other couplings, such as, for example, a tab and slot configuration that includes a lock or other structure to preclude opening. In other configurations, the cover may be hinged to the frame, and the structures may be maintained through any number of interfacing slots/tabs, threaded fasteners, among other configurations. It is further understood that housing may be formed from a frame that comprises an entire cubic configuration, and the cover may cover only extend over the top. There are further pluralities of different configurations of the housing, and the foregoing is merely a plurality of examples of the housing.

Figure 2:
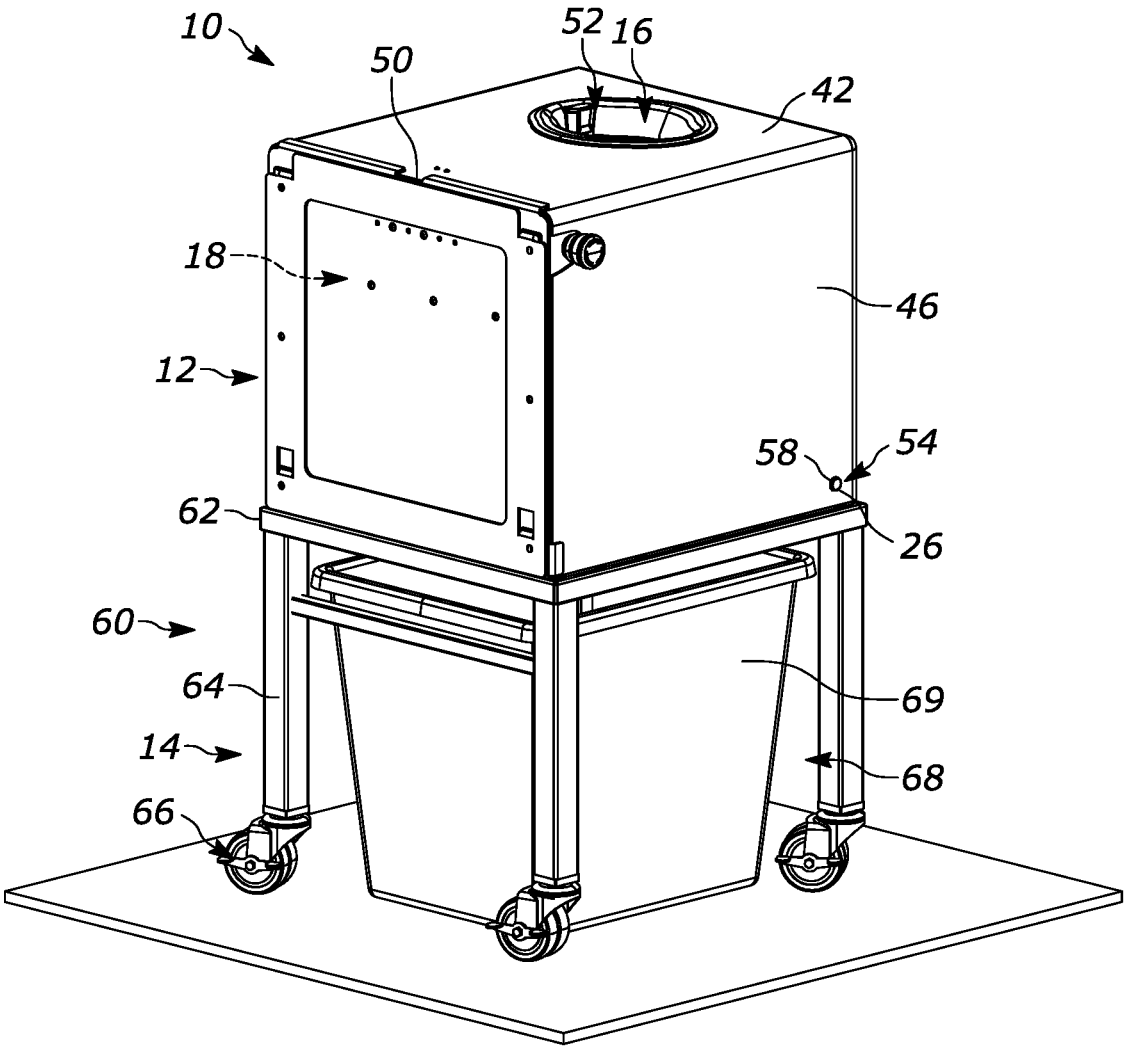
FIG. 2 of the drawings is a perspective view of a configuration of the container deposit return system of the present disclosure.
Figure 3:
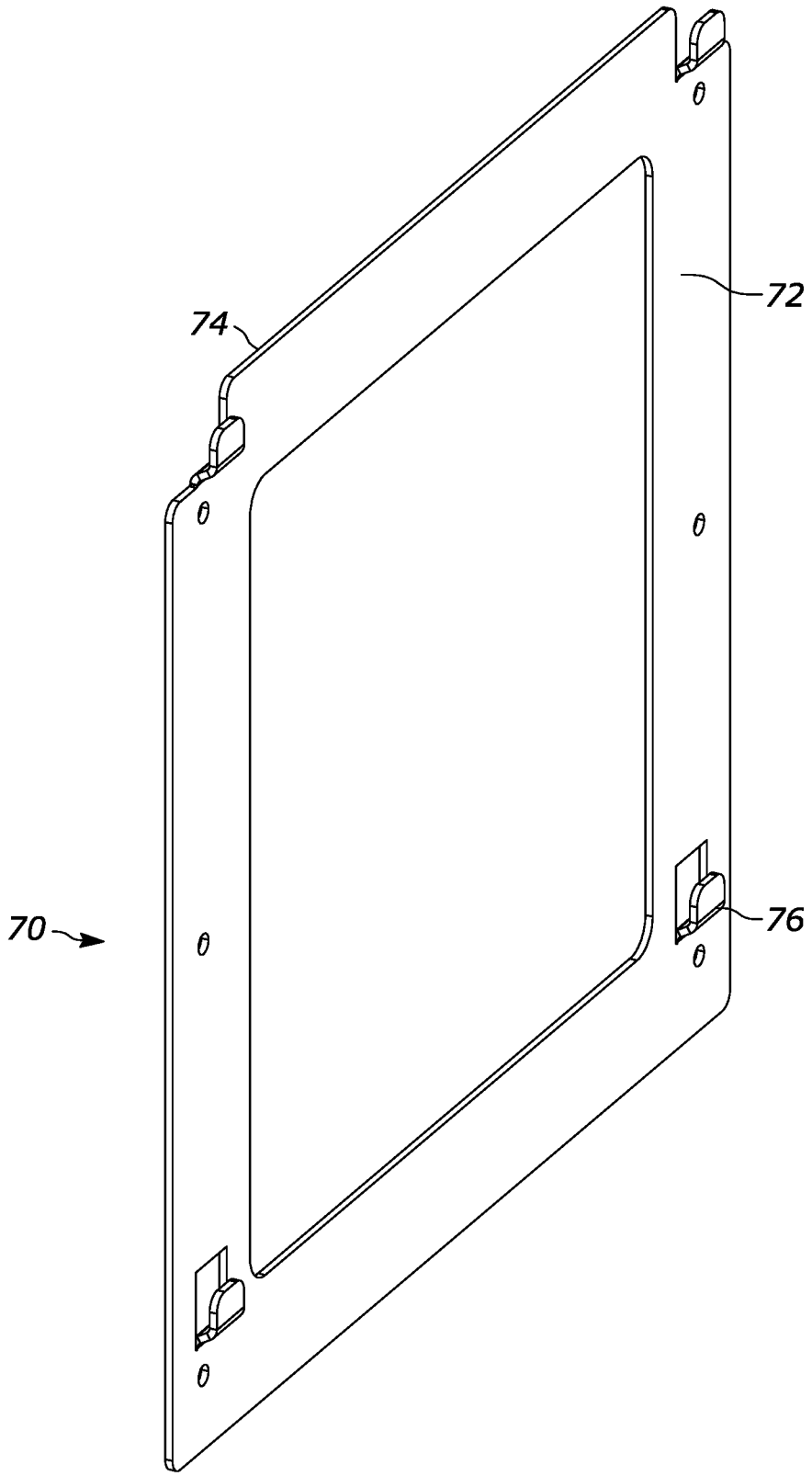
FIG. 3 of the drawings is a perspective view of wall mount plate of the housing mount system of the container deposit return system of the present disclosure.
Figure 4:
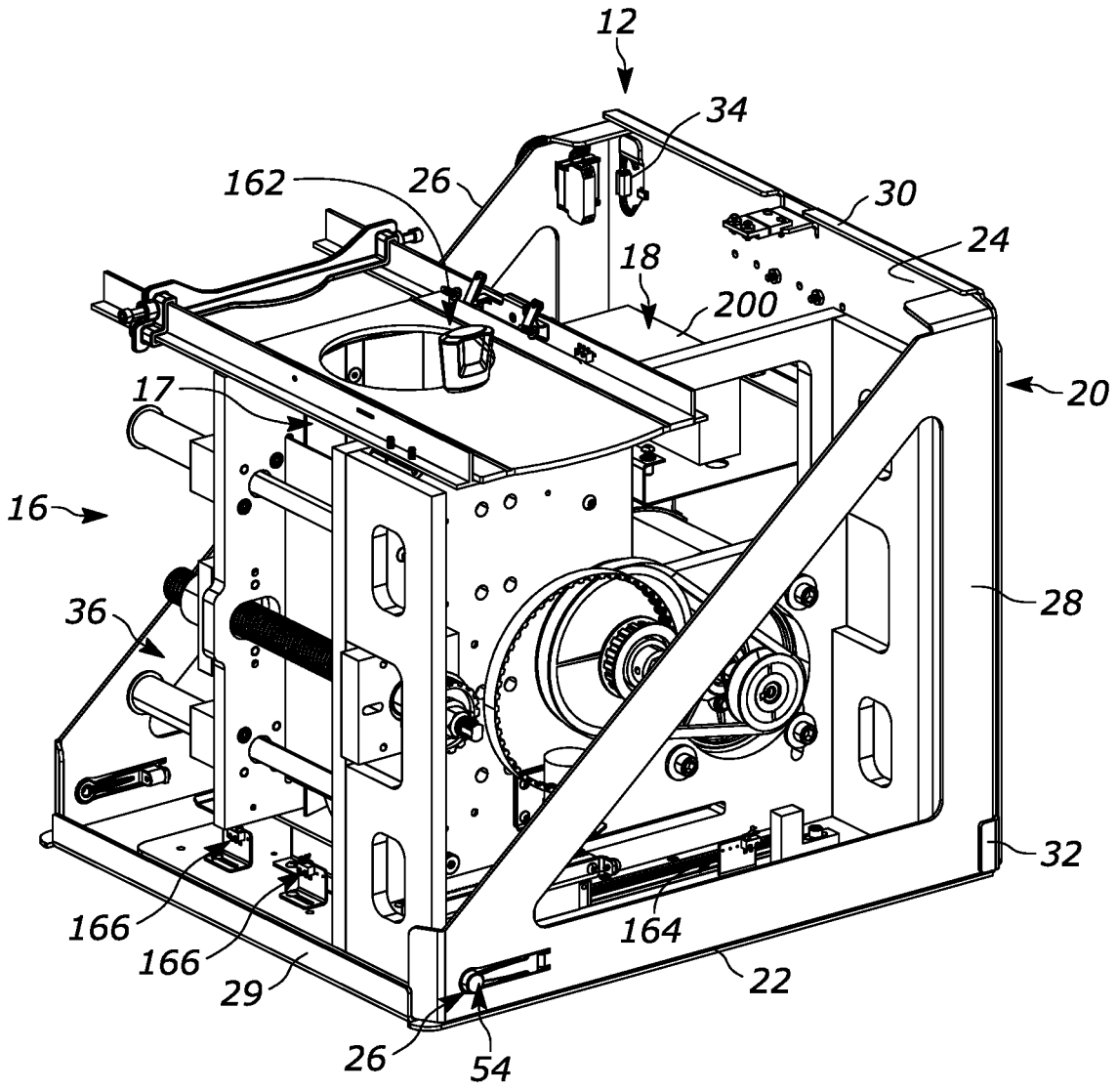
FIG. 4 of the drawings is a perspective view of the frame and the crushing assembly of the container deposit return system of the present disclosure.
Figure 5:
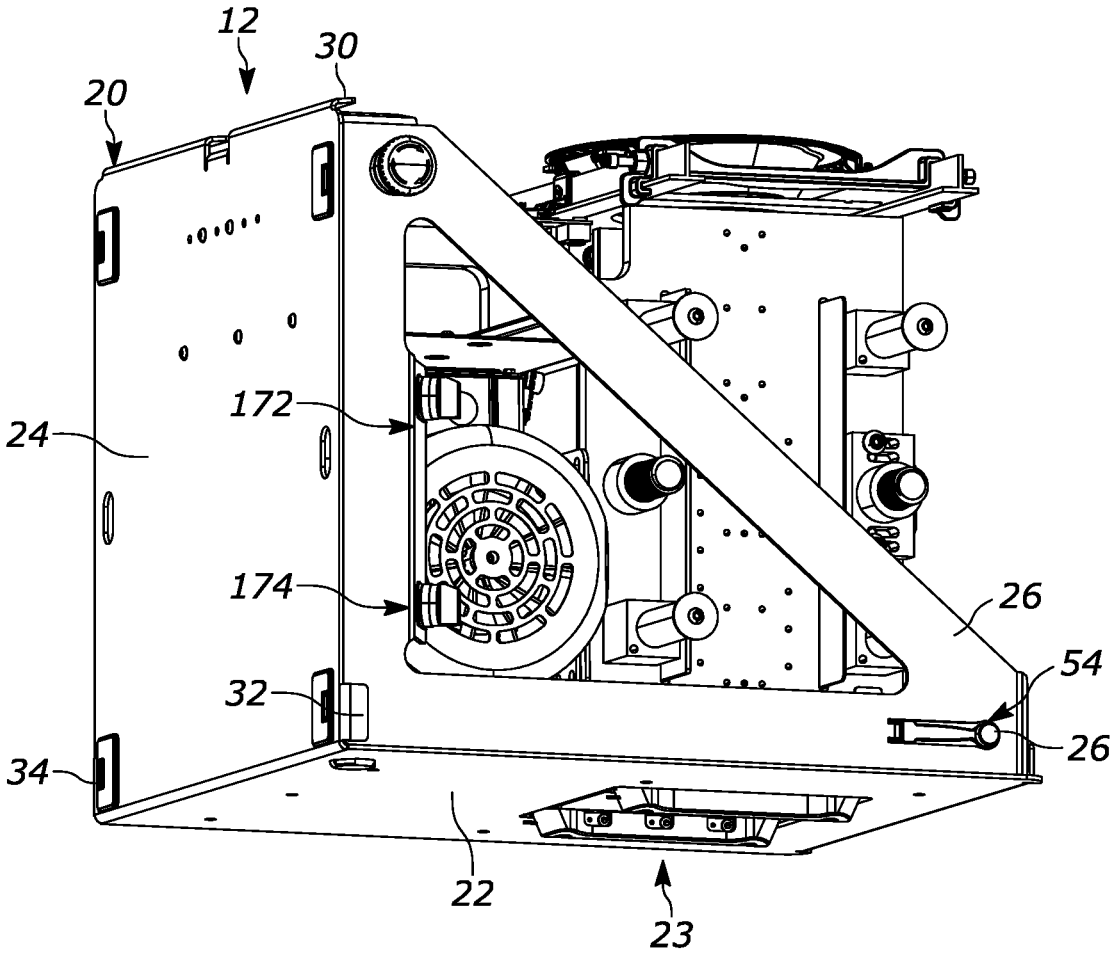
FIG. 5 of the drawings is a perspective view of the frame and the crushing assembly of the container deposit return system of the present disclosure.
Figure 6:
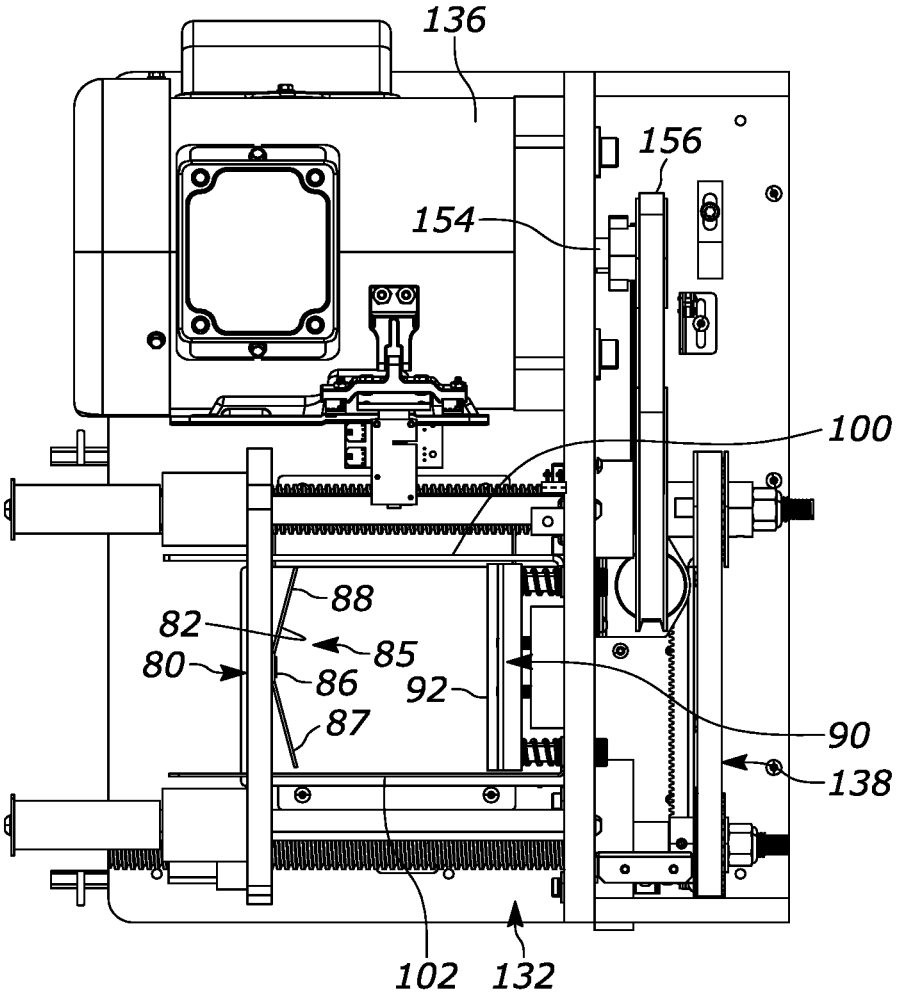
FIG. 6 of the drawings is a top plan view of the crushing assembly of the container deposit return system of the present disclosure, showing, in particular, the crush cavity thereof.
Figure 7:
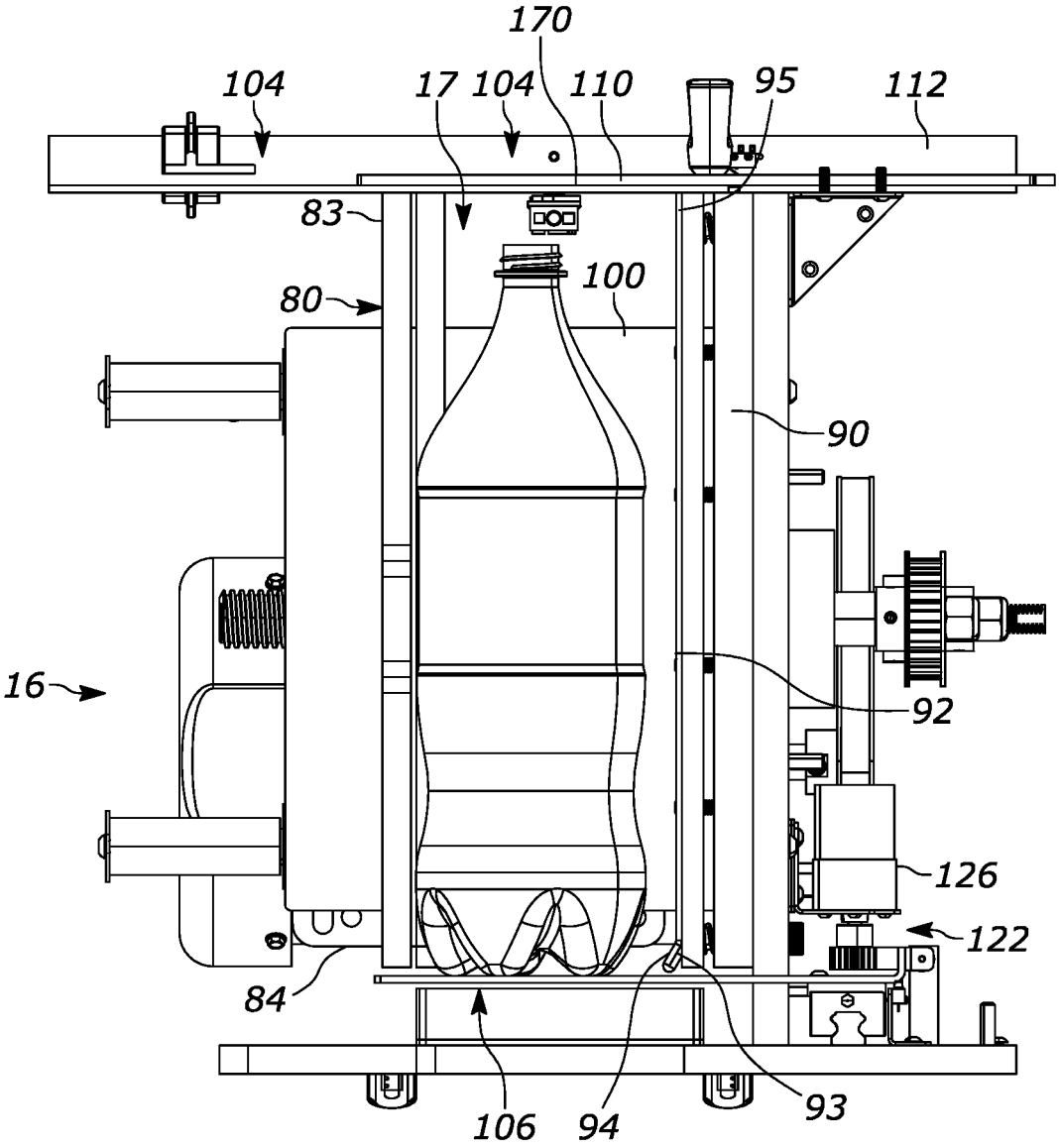
FIG. 7 of the drawings is a side elevational view of the crushing assembly of the container deposit return system of the present disclosure, showing, in particular, the crush cavity thereof having a bottle therein.
Figure 8:
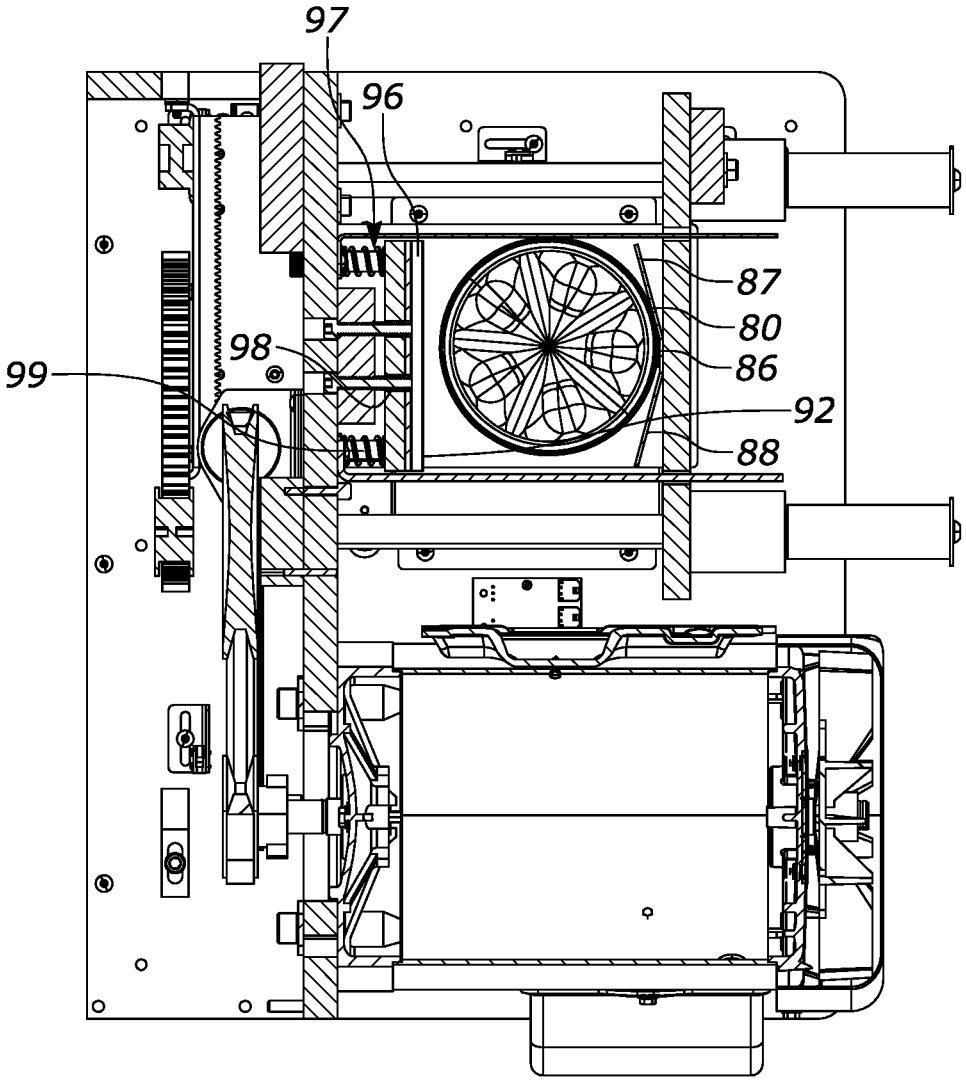
FIG. 8 of the drawings is a cross sectional view of the crushing assembly of the container deposit return system of the present disclosure, showing, in particular, the crush cavity thereof having a bottle therein.
Figure 9:
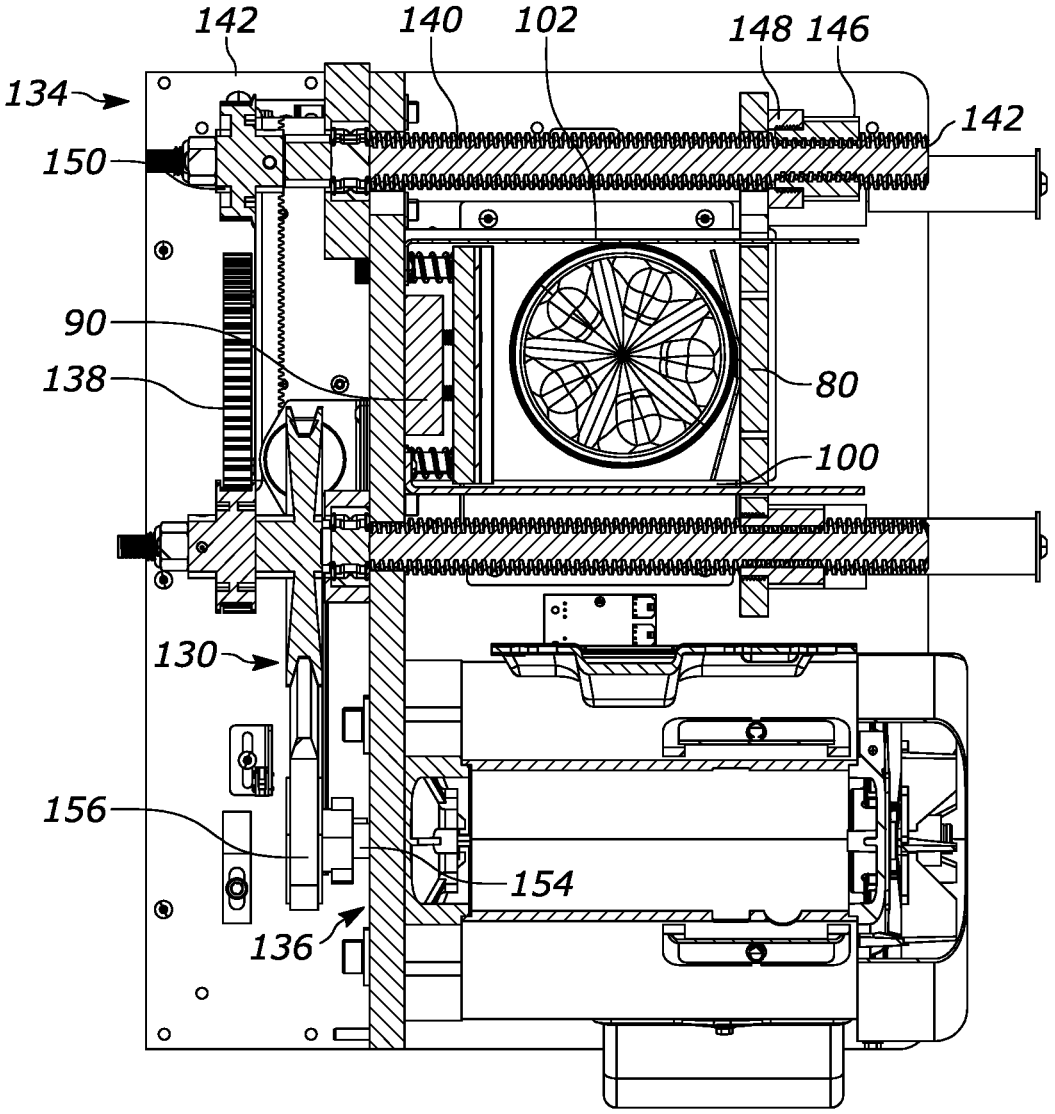
FIG. 9 of the drawings is a cross-sectional view of the crushing assembly of the container deposit return system of the present disclosure, showing, in particular the crushing wall movement assembly.
Figure 10:
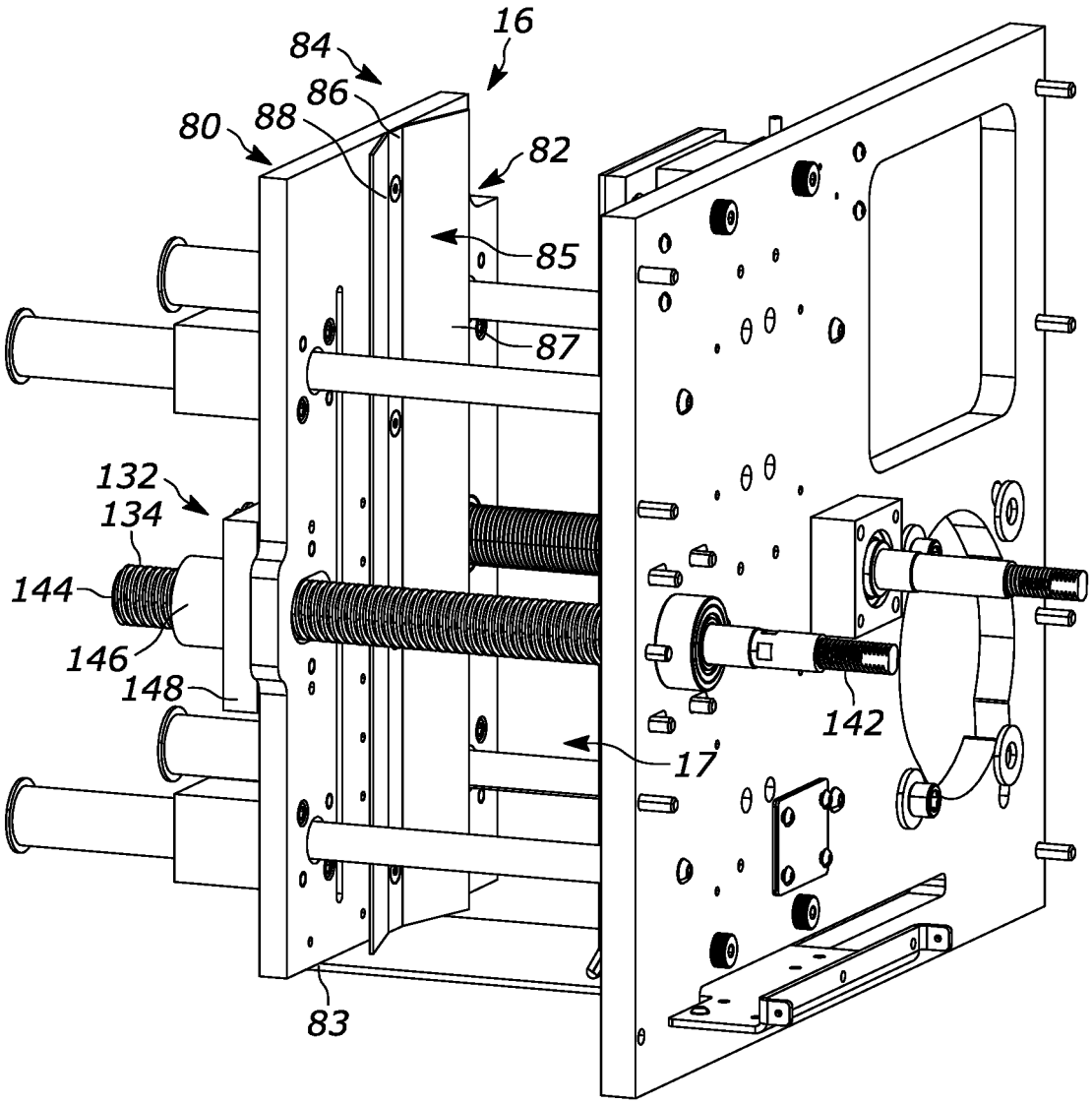
FIG. 10 of the drawings is a perspective view of the crushing assembly of the container deposit return system of the present disclosure, showing, in particular details of the first crushing wall.
Figure 11:
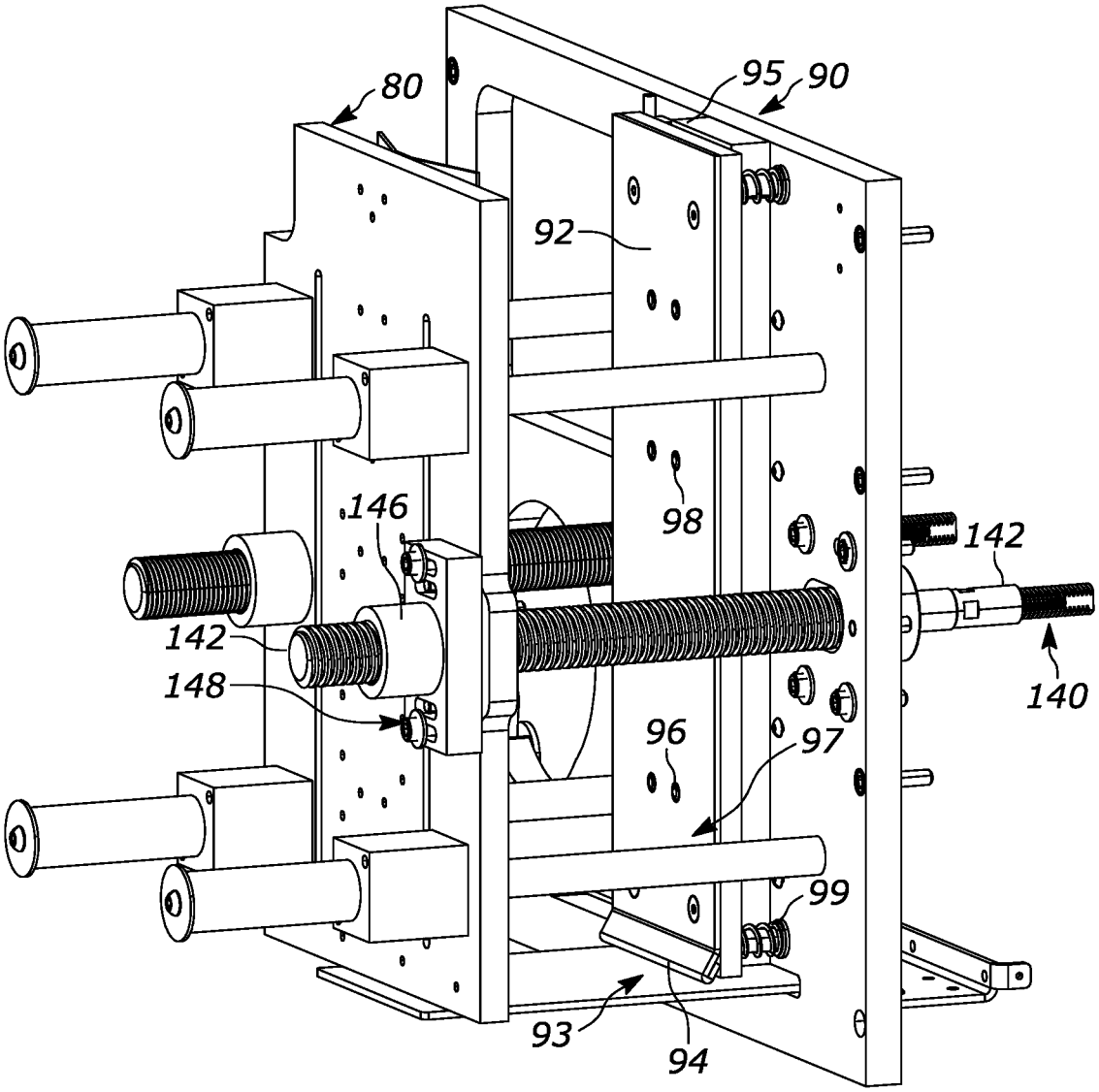
FIG. 11 of the drawings is a perspective view of the crushing assembly of the container deposit return system of the present disclosure, showing, in particular details of the second crushing wall.
Figure 12:
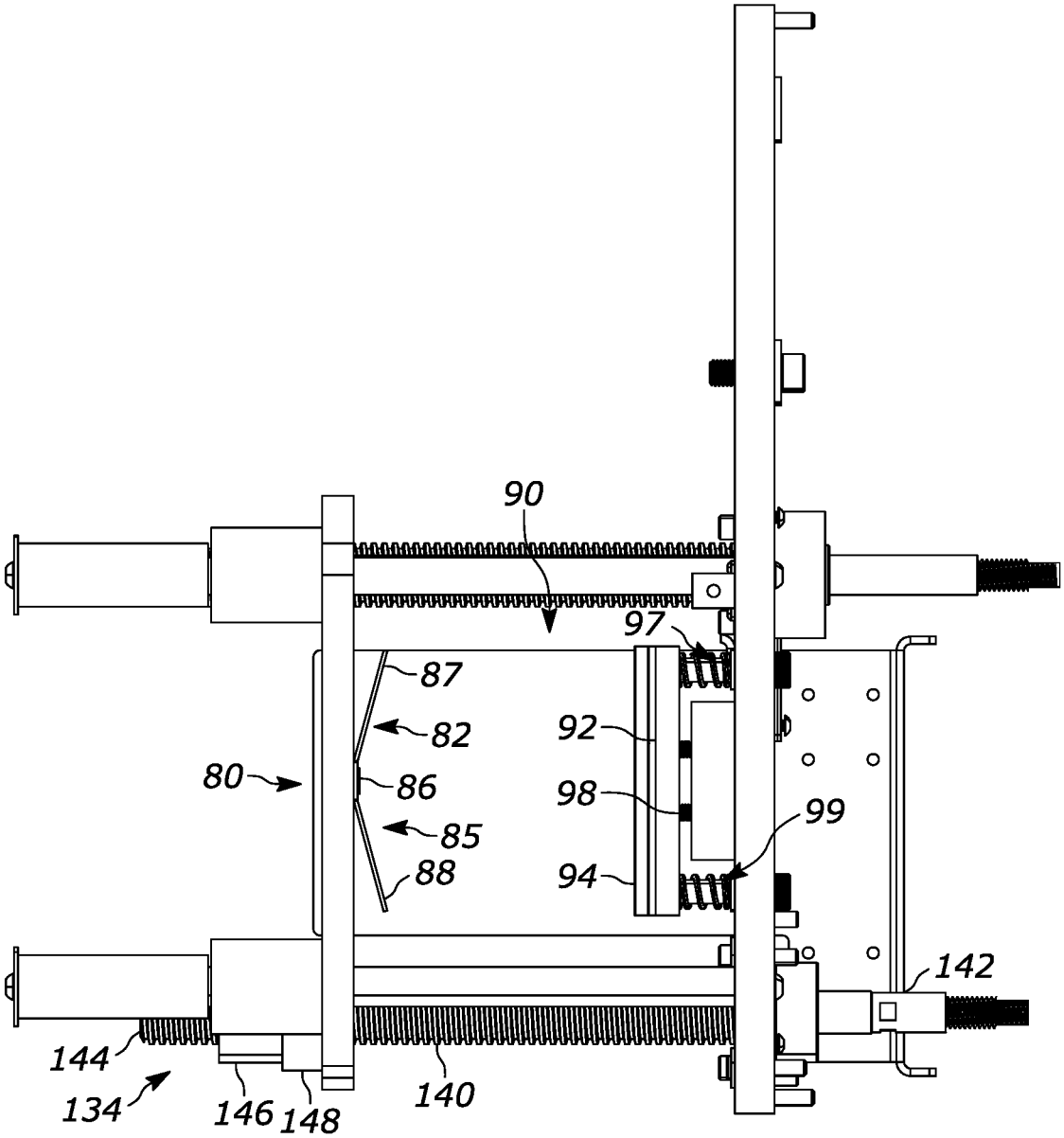
FIG. 12 of the drawings is a top plan view of the crushing assembly of the container deposit return system of the present disclosure.

The housing mount system 14 may comprise a floor stand 60 (FIGS. 1 and 2) or may comprise a wall mount plate 70 (FIG. 3). In the case of the former, the housing is configured for positioning on a floor stand which can be rolled around or moved around and positioned on the floor or ground. In the case of the latter, the housing can be mounted to a wall in, for example, a utility room or garage or the like. Other configurations are contemplated wherein the housing mount assembly may comprise a counter mount or a fully free-standing configuration that is integrally formed with the housing (i.e., the frame, for example).

In the case wherein the housing mount system 14 comprises a floor stand 60, the floor stand 60 includes 62 receiving platform which is configured to receive base 22 of the frame 20 of the housing. A plurality of legs 64 depend from the receiving platform and terminate at a lower end. Wheels or the like may be positioned at the lower end to provide mobility. The receiving platform and the legs define a lower cavity 68 which is configured to receive a recycling tote, such as, tote 69. In other configurations, an additional lower platform may be installed opposite the receiving platform so as to form a base for positioning of the recycling tote.

In other configurations, wherein a wall mounting is desired, a wall mount plate 70 can be provided. The wall mount plate 70 includes inner surface 72, outer surface 74 and flange tabs 76 which extend both inwardly and upwardly. To utilize the wall mount plate, the wall mount plate is mounted onto a wall with the outer surface 74 overlying the wall. The wall mount plate includes a plurality of openings through which fasteners may be extended into the wall to sandwich the wall mount plate between the head of the fasteners and the wall. Next, the housing can be attached to the wall mount plate by extending the flange tabs 76 into the slots 34 (FIG. 2) of the back wall of the frame. The flange tabs 76 act like hooks or hangers to be received into the slots and retained thereby.

It will be understood that in some configurations, a housing mount system can be omitted, and the device can be placed on a surface (with an opening corresponding to, for example, the bottom wall of the crush assembly). In other configurations, other custom types of housing mount assemblies are contemplated for use.

The crushing assembly 16 is shown in FIGS. 6 through 12 as comprising a crush cavity 17 and a crushing wall movement assembly 150. The crush cavity 17 is defined by a plurality of walls, including first crushing wall 80, second crushing wall 90, first side containing wall 100, second side containing wall 102, top wall assembly 104 and bottom wall assembly 106. In the configuration shown, the first crushing wall moves toward the second crushing wall in order to reduce the volume of the crush cavity, and to crush the can or bottle positioned therein. In addition, the crush cavity remains isolated from a user from the time the can or bottle is accepted into the crush cavity until it is crushed and allowed to pass (or fall) beyond the bottom wall assembly.

In more detail, the first crushing wall 80 is show as comprising inner side 82 which includes lower end 83 and upper end 84. The inner side 82 defines a centering surface 85 which is formed by a centrally located central region 86 which is opposed on either side by an inclined region that extends both away from the central region toward opposing containing walls but also toward the second crushing wall. A first side incline 87 extends from the central region toward the first side containing wall 100 and a second side incline 88 extends from the central region toward the second side containing wall 102. It is contemplated that the inclines may be inclined at an angle of between 5° and 60° and more preferably between 10° and 45° and more preferably between 20° and 30°. In some configurations, the first and second inclines may be mirror images of each other taken about an axis that bisects the central region, and the width of the central region may be less than or substantially less than the width of the first side incline or the second side incline. In addition, in some configurations, the inclines may be omitted.

The second crushing wall 90 includes inner side 92 which has a lower end 93 and an upper end 95. The lower end 93 includes an inclined lip 94 that extends both downwardly and toward the first crushing wall to generally terminate the lower end. The inclined lip 94 tends to slightly lift or incline cans (such as, for example, a 12 oz beverage can) which both precludes shearing of the bottom of the can between the second crushing wall and the bottom wall and also aligns the can into a position that crushes the can by flattening the bottom and the top against the sides as opposed to crushing the top and bottom toward each other (in a configuration wherein the top and the bottom are generally perpendicular to each other. It is contemplated that an inclined lip may be incorporated into the first crushing wall in some configurations.

When containers are crushed that are sealed (such as a 2 liter bottle having a cap thereon), it is advantageous to also poke holes or perforations into the bottle. This not only makes it easier to crush, but also destroys the bottle and limits the possibility of re-running the same bottle for an additional deposit. It is however, generally not necessary to poke holes or perforations into cans (although the same can be done generally without issue).

In order to poke holes, a puncture assembly 97 is provided and openings are disposed along the inner side of the second crushing wall 90. The puncture assembly 97 comprises a plurality of pins 98 that are generally perpendicular to the inner side of the second crushing wall, and which are positioned within the openings. These pins may be fixedly coupled to a fixed wall positioned behind the second crushing wall. A biasing member or members biases the inner side of the second crushing wall away from the underlying fixed wall so that, preferably, the pins remain within the openings and do not extend beyond the inner side 92. In the event that the bottle is sealed, when it is crushed, the first crushing wall will exert sufficient force against the bottle that the bottle will press against the inner side of the second crushing wall to overcome the biasing member(s) and to, in turn, extend the pins beyond the inner side of the second crushing wall. The pins then extend into the bottle and form holes or perforations therein. This will allow further crushing (at a lower force, and without catastrophic and disastrous failure of the bottle within the crush cavity). The pins can be strategically positioned so as to form multiple holes into the bottle, and to be able to interact with bottles of different sizes and shapes. In the configuration shown, eight pins are positioned in a four by two matrix to extend through the inner side of the crushing wall.

Other systems are contemplated for the puncture assembly, such as linearly driven or rotatably driven pins, knives, edges or the like that can poke a hole into the bottle at a predetermined time, or when a sufficiently high force is encountered during crushing.

The first side containing wall 100 and the second side containing wall 102 are positioned on opposing sides of each other and span between the first crushing wall and the second crushing wall. The containing walls generally are fixed to the frame and the first crushing wall moves relative to the containing walls on either side of the first crushing wall. In some configurations, the crushing walls may be transparent, or partially transparent so as to allow for visibility within the crush cavity 17 during operation and crushing of a bottle or a can. The cameras that will be described below may be positioned on the outside of the crush cavity and may take pictures through the transparent portions of the containing walls. In some configurations, the crushing walls may be omitted, due to centering or other structures to preclude the inadvertent sideways movement of the bottle or can within the container.

The top wall assembly 104 provides ingress into the crush cavity and is how bottles and cans are dropped into the crush cavity. In the configuration shown, the top wall assembly 104 includes top wall 100 which is slidably positionable due to the interface with slidable coupling 112 between a first open position and a second closed position. In the first open position, the top wall is out of the way of the opening, and a bottle or can may be placed within the crush cavity. In the second closed position, the top wall is slid into position to cover the opening of the frame and to preclude ingress of a bottle or a can (or any portion of a user, such as a finger or hand of a user) into the crush cavity. A lock 114 may be utilized to maintain the top wall in either of the first position or the second position. In addition, and as will be described, position sensors may be utilized to determine the position of the top wall (to preclude or allow movement of the first crushing wall to crush a can or bottle within the crush cavity).

In other configurations, it will be understood, the top wall assembly may comprise a top wall that opens, for example, outwardly, and that can be hinged to the cover or to the crush assembly, instead of a slidably positionable top wall. As with any such top wall, the operation thereof may be manual or may be automatic, or sensor driven through actions by the user, for example.

Additionally, in some configurations, multiple top walls are contemplated, some that are sequential for safety, or side by side to provide smaller top wall portions for a larger opening, for example. In some configurations, the top wall may be part of the crushing assembly and coupled to the frame (directly or indirectly), whereas in other configurations, the top wall may be part of the cover. In still other configurations, the top wall may be a separate member which is released from both the frame and the cover.

The bottom wall assembly 106 is positioned opposite the top wall assembly and provides the base of the crush cavity 17. The bottom wall assembly includes bottom wall 120, and slidable coupling 122 that can move the bottom wall between a first retain position to a second disposal position. An actuator 126 can be utilized to direct the bottom wall between the first retain position and the second disposal position. In some configurations, the actuator 126 may comprise a linear actuator, although other actuators are contemplated, such as, for example, solenoids or the like. Additionally, sensors can be utilized to determine the position of the bottom wall. It will be understood that the can or bottle is positioned on the upper surface of the bottom wall when deposited into the crush cavity.

The crushing wall movement assembly 150 facilitates the reduction in size of the crush cavity 17 by facilitating movement of the first crushing wall relative to the second crushing wall. The crushing wall movement assembly 132 comprises linear actuator 132. In the configuration shown, the linear actuator comprises a lead screw assembly 134, a motor 136 and a cogged belt 138. Cooperatively, the linear actuator moves the first crushing wall relative to the second crushing wall. It will be understood that in the configuration shown, the second crushing wall remains stationary while the first crushing wall is moved relative thereto. In other configurations, it is contemplated that both the first and the second crushing walls may move, and in some instances simultaneously, toward and away from each other to effectuate crushing as desired.

It will be understood that multiple lead screw assemblies 134 may be utilized for a particular application. In the configuration shown, a total of two lead screw assemblies are utilized with each lead screw assembly positioned on opposing sides of the first and second crushing wall and spanning therebetween. One lead screw assembly will be described with the understanding that the second lead screw assembly is substantially identical thereto. The lead screw assembly 134 comprises lead screw 140, lead nut 146 and cogged gear 150. The lead nut is fixedly coupled to the first crushing wall. The lead screw has a first end 142 that extends beyond the second crushing wall while being rotatably coupled thereto by way of, for example, a bearing, and terminates with cogged gear 150. The second end 144 of the lead screw is threaded through the lead nut 146 and extends beyond the first crushing wall.

The motor 136 includes an output shaft 154 onto which a pulley 156 is coupled. The pulley is coupled through a belt to another pulley of a lead screw. A cogged belt 138 spans between and interfaces between lead screw to insure simultaneous movement of the lead screws so as to remain in unison. As the motor rotates, belt drives one lead screw, and the cogged belt effectuates rotation of the other lead screw in unison, each relative to the respective lead nut. This causes linear motion of the lead nut and, in turn, the first crushing wall. The rate of movement of the first crushing wall is determined by the speed of rotation of the lead screw.

In the configuration shown, each of the two lead screw assemblies are coupled to the motor (or to each other and indirectly to the motor) so as to rotate in unison and to provide movement and force on opposite sides (to, in turn minimize any torque or moment arms developing in the first crushing wall). In the instance of a single lead screw, it will be understood that such a configuration can be driven with a belt and pulley system, as the precision of a cogged belt may not be needed for a single lead screw. It will further be understood that guide shafts or guide slots may be employed to assist with the movement of the first crushing wall toward and away from the second crushing wall, and to preclude inadvertent rotation, side to side, or top to bottom translation of the first crushing wall relative to the second crushing wall.

Other linear actuators are likewise contemplated, such as, for example, ball or roller screws or the like. Additionally, it is contemplated that in the place of a belt or the like, a gear train may be utilized, or the motor may directly drive the lead screw.

Figure 13:
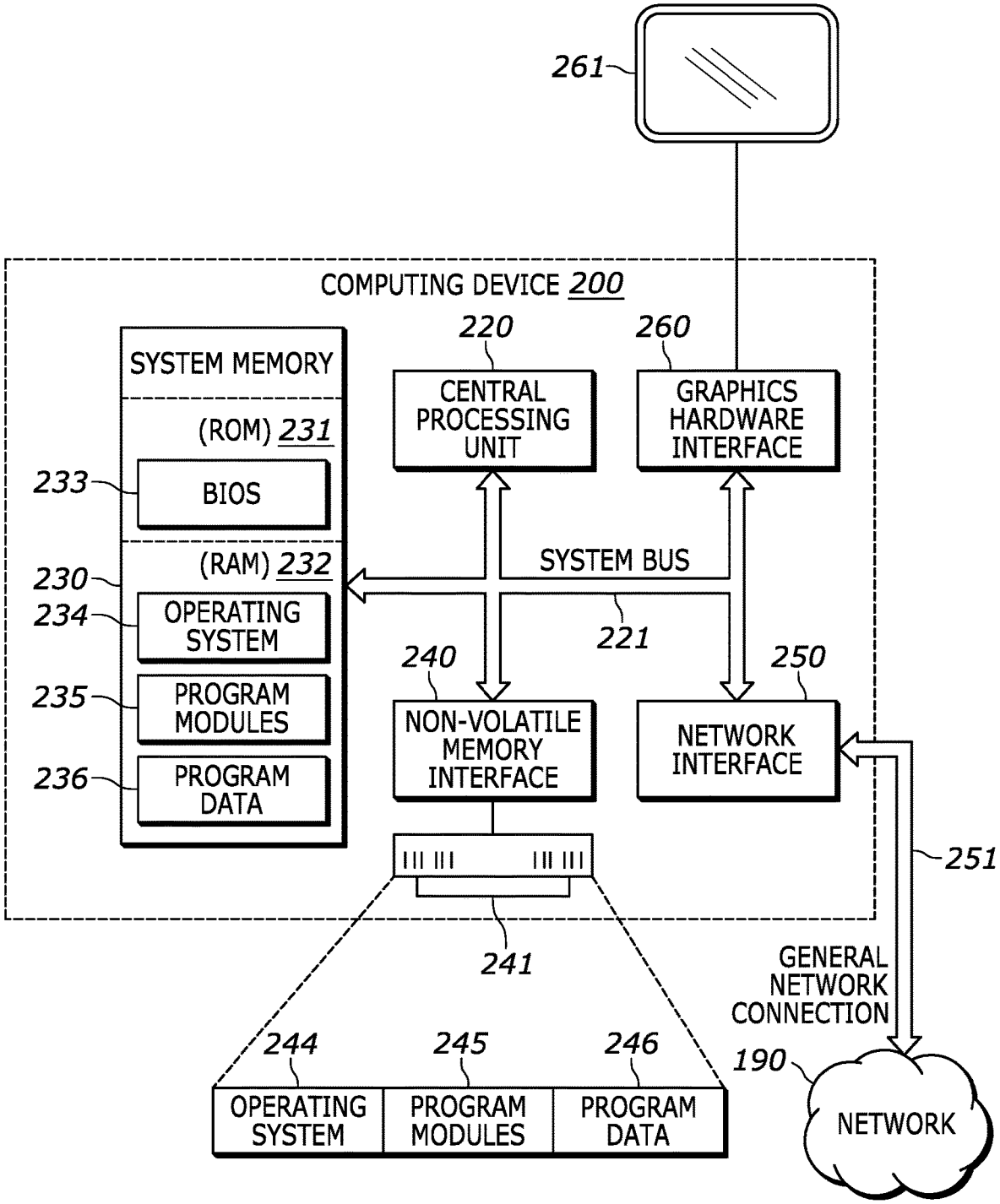
FIG. 13 of the drawings is a schematic representation of the computing device of the present disclosure.

The control system 18 includes a computing device 200, and a plurality of sensors and controllers (which will be described below). Turning to FIG. 13, an exemplary computing device 200 is illustrated which can perform some or all of the mechanisms and actions described above. The exemplary computing device 200 includes, but is not limited to, one or more central processing units (CPUs) 220, a system memory 230, and a system bus 221 that couples various system components including the system memory to the processing unit 220. The system bus 221 may be any of several types of bus structures including a memory bus or memory controller, a peripheral bus, and a local bus using any of a variety of bus architectures. The computing device 200 can optionally include graphics hardware, including, but not limited to, a graphics hardware interface 260 and a display device 261, which includes display devices capable of receiving touch-based user input, such as a touch-sensitive, or multi-touch capable, display device. Depending on the specific physical implementation, one or more of the CPUs 220, the system memory 230 and other components of the computing device 200 can be physically co-located, such as on a single chip. In such a case, some or all of the system bus 221 can be nothing more than silicon pathways within a single chip structure and its illustration in FIG. 13 can be nothing more than notational convenience for the purpose of illustration.

The computing device 200 also typically includes computer readable media, which includes any available media that can be accessed by computing device 200 and includes both volatile and nonvolatile media and removable and non-removable media. By way of example, and not limitation, computer readable media may comprise computer storage media and communication media. Computer storage media includes media implemented in any method or technology for storage of content such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired content and which can be accessed by the computing device 200. Computer storage media, however, does not include communication media. Communication media typically embodies computer readable instructions, data structures, program modules or other data in a modulated data signal such as a carrier wave or other transport mechanism and includes any content delivery media. By way of example, and not limitation, communication media includes wired media such as a wired network or direct-wired connection, and wireless media such as acoustic, RF, infrared and other wireless media. Combinations of the any of the above should also be included within the scope of computer readable media.

The system memory 230 includes computer storage media in the form of volatile and/or nonvolatile memory such as read only memory (ROM) 231 and random access memory (RAM) 232. A basic input/output system 233 (BIOS), containing the basic routines that help to transfer content between elements within computing device 200, such as during start-up, is typically stored in ROM 231. RAM 232 typically contains data and/or program modules that are immediately accessible to and/or presently being operated on by processing unit 220. By way of example, and not limitation, FIG. 13 illustrates operating system 234, other program modules 235, and program data 236.

The computing device 200 may also include other removable/non-removable, volatile/nonvolatile computer storage media. By way of example only, FIG. 13 illustrates a hard disk drive 241 that reads from or writes to non-removable, nonvolatile magnetic media. Other removable/non-removable, volatile/nonvolatile computer storage media that can be used with the exemplary computing device include, but are not limited to, magnetic tape cassettes, flash memory cards, digital versatile disks, digital video tape, solid state RAM, solid state ROM, and other computer storage media as defined and delineated above. The hard disk drive 241 is typically connected to the system bus 221 through a nonvolatile memory interface such as interface 240.

The drives and their associated computer storage media discussed above and illustrated in FIG. 13, provide storage of computer readable instructions, data structures, program modules and other data for the computing device 200. In FIG. 2, for example, hard disk drive 241 is illustrated as storing operating system 244, other program modules 245, and program data 246. Note that these components can either be the same as or different from operating system 234, other program modules 235 and program data 236. Operating system 244, other program modules 245 and program data 246 are given different numbers hereto illustrate that, at a minimum, they are different copies.

The computing device 200 may operate in a networked environment using logical connections to one or more remote computers. The computing device 200 is illustrated as being connected to the general network connection 251 (to a network 190) through a network interface or adapter 250, which is, in turn, connected to the system bus 221. In a networked environment, program modules depicted relative to the computing device 200, or portions or peripherals thereof, may be stored in the memory of one or more other computing devices that are communicatively coupled to the computing device 200 through the general network connection 221. It will be appreciated that the network connections shown are exemplary and other means of establishing a communications link between computing devices may be used.

Although described as a single physical device, the exemplary computing device 200 can be a virtual computing device, in which case the functionality of the above-described physical components, such as the CPU 220, the system memory 230, the network interface 260, and other like components can be provided by computer-executable instructions. Such computer-executable instructions can execute on a single physical computing device, or can be distributed across multiple physical computing devices, including being distributed across multiple physical computing devices in a dynamic manner such that the specific, physical computing devices hosting such computer-executable instructions can dynamically change over time depending upon need and availability. In the situation where the exemplary computing device 200 is a virtualized device, the underlying physical computing devices hosting such a virtualized computing device can, themselves, comprise physical components analogous to those described above, and operating in a like manner. Furthermore, virtual computing devices can be utilized in multiple layers with one virtual computing device executing within the construct of another virtual computing device. The term "computing device", therefore, as utilized herein, means either a physical computing device or a virtualized computing environment, including a virtual computing device, within which computer-executable instructions can be executed in a manner consistent with their execution by a physical computing device. Similarly, terms referring to physical components of the computing device, as utilized herein, mean either those physical components or virtualizations thereof performing the same or equivalent functions.

Amongst other sensors, the control system includes a can identifying sensor positioned proximate the top wall assembly 104 (FIG. 1) and/or the access opening 52 in the top of the cover 40. The can identifying sensor may comprise a bar code scanner that is configured to read the bar code of the can or bottle that is to be introduced into the crush cavity. It will be understood that in some configurations, such a sensor may be positioned so that the bar code is read when the can is positioned within the crush cavity (wherein the can or bottle may either be crushed or rejected, or crushed, but without deposit recorded depending on the type of can or bottle that is being crushed).

The sensors further include door position sensors 162, 164 (FIG. 4) which can determine the position of the top wall and the bottom wall, respectively, to determine as to the position of either one of these walls. These sensors can be utilized to determine if it is safe to crush a can or bottle, and/or to determine if it is time to open and allow the introduction or the removal of a can or bottle. Among other safety sensors, cover install sensor can be associated with the frame and the cover to determine and/or confirm the installation of the cover onto the frame.

The sensors further include a first wall position sensor 166 (FIG. 4) that can facilitate the determination of the first crushing wall.

The sensors further include an imaging sensor 170 (FIG. 7) which can take images of the crush cavity and the contents of the crush cavity (crushed or not crushed can or bottle) before, during and/or after the crushing of a can or bottle. As will be described below, the imaging of the bottle or can before and after crushing can be utilized to determine the accuracy of the crushing and also to determine the accuracy of a return of a deposit or the like. It will be understood that the imaging sensor may comprise a camera or the like of sufficient resolution. It will further be understood that multiple imaging sensors 170 may be incorporated so as to effectuate improved imaging of the crush cavity before, during and/or after crushing of a can or bottle.

Figure 14:
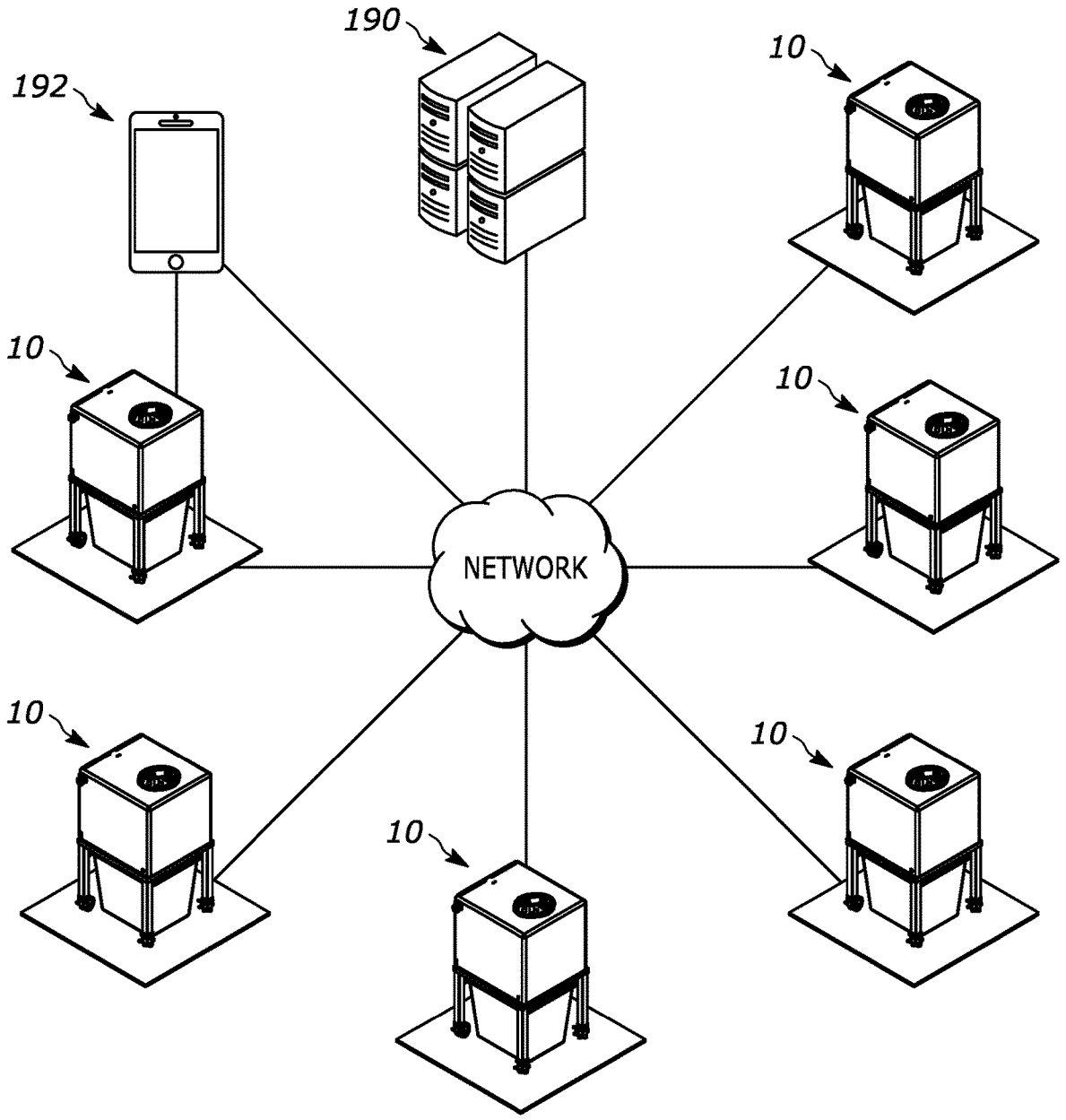
FIG. 14 of the drawings is a schematic representation of a plurality of the container deposit return systems coupled to a server via a network so as to be in communication with the same.

The operation of the container deposit return system will be described with the understanding that variations in the operation are contemplated. First, the system is turned on and the control system connects through Wi-Fi (or other means, such as Bluetooth, a wired connection, ZigBee, among others) to a router and then connects to a server which can be administered by the can refund authority, a grocery store, or another type of organization. In a contemplated configuration, and with reference to FIG. 14, a plurality of container deposit return systems 10 can be associated with one or more servers, such as servers 190. Where a connection cannot be established, the system can store in memory scans and pictures of cans which can be uploaded at a later time when a connection is established.

Once the system is ready, the user opens the top wall and prepares a can for deposit into the crush cavity. The can is first directed to the access opening 52 in the cover where the can identifying sensor 160 can read the bar code on the can. It will be understood that the same procedure can be utilized for a can or bottle, so when the process is described with respect to a can, it will be understood that a bottle can be utilized in place of a can. As the bar code is read, the system can determine as to whether a deposit can be obtained by returning the scanned can. In some configurations, the control system will have a listing of acceptable bar codes for which a return can receive a refund of a deposit. In other instances, the control system can communicate with the remote server to make such a determination.

In the configuration contemplated, if the can is not of the type that can be returned for a refund, the system can reject the can and the system can be configured not to crush such a can. Thus, even if the user drops it into the crush cavity, the bottom wall can open and release the can. In other configurations, to proceed, the user can remove the can from within the crush cavity. In still other configurations, the system may be configured to crush the can but just not to provide a refund. Such configuration capabilities are contemplated for the control system.

If, on the other hand, the can is of the type for which a refund can be obtained, the system can make an indication of the same (for example, a red light may flash for a reject whereas a green light may flash for an acceptable can). The user can then drop the can into the crush cavity. Once dropped into the crush cavity, the user can close the top wall to fully seal the crush cavity 17. Once closed, the imaging sensor 170 is activated and a picture of the can is taken prior to crushing.

After the picture is taken, the can is crushed by the crushing assembly. In more detail, the crushing wall movement assembly is started, and the motor is activated. As the motor rotates, the rotation of the motor is translated to the lead screws which rotate relative to the lead nuts coupled to the first crushing wall. Rotation of the lead screws translates into linear movement of the first crushing wall toward the second crushing wall. Eventually, the first crushing wall contacts the can and further movement directs the can into contact with the second crushing wall (if such contact did not already exist). The can encounters the inclined lip at the lower end of the second crushing wall, thereby slightly lifting, and/or canting, of the can as the first crushing wall continues to move toward the second crushing wall. Continued movement crushes the can between the first and second crushing walls. The ending position of the first crushing wall can be varied and can be adjustable depending on the desired amount of crushing that is desired.

In the instance wherein the container to be crushed is a bottle and the bottle has a top that creates an enclosed and sealed cavity, as the first crushing wall pushes the bottle toward and into contact with the second crushing wall, continued movement will tend to overcome the biasing members 99 which will move the second crushing wall and direct the pins through the openings in the second crushing wall so as to introduce holes and punctures into the bottle. This unseals the bottle and permits further crushing. Depending on the position and resistance of the biasing members, the amount of force required to expose the pins can be varied such that they activate at, for example, lower or higher forces. In some instances, it may be desirable to have the pins direct openings into each can and bottle, regardless of configuration. It will also be understood that when the compressive force of the first crushing wall is released, the pins retract into the openings, so as not to be coupled inadvertently to the can or bottle.

Once the end of travel is reached by the first crushing wall, the motor is reversed and the first crushing wall is directed away from the second crushing wall. Eventually, the first crushing wall returns to its original position. At such time, or prior to such time, the imaging sensor takes another picture of the can, now crushed (or during crushing, or both). These pictures are sent (along with bar code data, in some instances) to the server (real time, or delayed). At the server, a determination is made as to whether the picture of the can prior to crushing and after crushing correspond to each other and, in some instances, whether the pictures of the can correspond to the bar code that was read. If there is correlation, then the system indicates that the can is accepted for return. It is contemplated that the user has a virtual wallet, or a virtual account in the overall system, and that when the can is accepted for return, the user's account is credited.

It is contemplated that machine learning can be utilized to automate the acceptance and/or rejection of the can for return of the deposit. It is contemplated that the images may also be manually reviewed, or that there can be a combination of manual and automated review of the images. Wherein the system becomes disconnected from the server and the service operator, the data pertaining to the cans can be stored locally. It is contemplated that the bar codes may be downloaded to the control system at predetermined intervals (i.e., hourly, daily, weekly, etc.) so that regardless of connectivity, the system can accept or reject based on bar codes in a real time manner.

Once the first crushing wall has returned to its initial position, the bottom wall can open and the can passes therethrough and into the recycling tote positioned below the bottom wall. The system is ready for accepting a subsequent can or bottle.

In the event that the system jams and a can or bottle remains in the system, manual operation may be necessary. In such a configuration, the cover can be removed. Once the cover is removed, the system is configured to recognize the removal through the top install sensor and to not allow movement of the first crushing wall. At such time, the top wall can be opened, or the bottom wall can be opened and the can is manually removed. If it becomes necessary to move the first crushing wall, a plurality of override switches 172, 174 are provided. To minimize any possibility of injury, both switches must be operated (one by each hand) in order to move the first crushing wall.

Once the obstruction is removed, the cover can be reinstalled. The system can be turned off and on, or a reset button may be provided to cycle the system and to place it in a condition for accepting a subsequent container.

It is further contemplated that a user may have his or her account linked to a bank account or to a mobile application which can provide further functionality to the user. For example, the mobile application (or web application, or PC application) represented by 192 in FIG. 14 can communicate directly or indirectly with the system 10 and/or the server 190 as far as status and the like. Additionally, the system can determine trends of the user and make suggestions, provide coupons or the like to the user. Additionally, the mobile application may be tied to the user's bank account, or may generate credit cards, gift cards, store cards or the like for the user that the user can utilize at a store or on-line. Furthermore, the mobile application may provide any necessary agreements (like an agreement that the crushed cans will be recycled and not thrown in refuse containers), any end user license agreements and/or other agreements. It will further be understood that the systems may be connected with a single grocery store for example, or that they may be connected to a third party provider that may be connected with multiple return locations (i.e., multiple different types of stores or different types of grocery chains, or gas stations, among other types of locations).

Advantageously, the system provides an at home or office means by which to return bottles and cans for deposit refund. Currently, grocery stores and the like perform many of such functions. However, the cost to the grocery store and the like can be substantial, as is the maintenance and upkeep of the system. Having such a system increases user participation while lessening the burden on grocery stores and chains and the like.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A container deposit return system having:

a housing;

a crushing assembly positioned within the housing, the crushing assembly having a first crushing wall and a second crushing wall spaced apart from the first crushing wall defining a crush cavity, and, a crushing wall movement assembly structurally configured to move the first crushing wall relative to the second crushing wall to direct the first crushing wall toward and away from the second crushing wall, to, in turn, crush a container positioned within the crush cavity through crushing contact by and between the first and second crushing walls;

a lock selectively allowing and precluding access into the crush cavity; and a control system, the control system having at least one imaging sensor, the imaging sensor is positioned within the housing and configured to record an image of the crush cavity between the first and second crushing walls and the container within the crush cavity between the first and second crushing walls before crushing of the container and after crushing of the container, wherein the imaging sensor is configured to record an image of the crush cavity, the first and second crushing walls and the container before and after crushing the container while a top wall assembly remains in a second closed position and the bottom wall remains in a first retain position, locking the crush cavity and precluding access thereto during activation of the image sensor to record the image of the container before crushing and after crushing, and wherein the crushing assembly is configured to start crushing the container, after the imaging sensor records the image of the container before crushing the container, and unlocking after the image sensor records the image of the container after crushing.

2. The container deposit return system of claim 1 wherein the control system further includes a can identifying sensor structurally configured to identify the can through a bar code on the can.

3. The container deposit return system of claim 1 wherein the first crushing wall further includes an inner side having a centering surface which is structurally configured to center the can thereon.

4. The container deposit return system of claim 3 wherein the centering surface further includes a central region, a first side incline positioned to one side of the central region and a second side incline positioned to a second side of the central region, the first and second inclined portions extending away from the central region and also toward the second crushing wall.

5. The container deposit return system of claim 1 wherein the second crushing wall further comprises a puncture assembly, comprising a plurality of pins extendable through a plurality of openings in the second crushing wall and a biasing member biasing the pins relative to the second crushing wall, whereupon overcoming the biasing member, the plurality of pins extend through the plurality of openings.

6. The container deposit return system of claim 1 wherein the crush cavity is defined by the first crushing wall and the second crushing wall, a first side containing wall and a second side containing wall positioned opposite the first side containing wall, the first side and second side containing walls spanning between the first crushing wall and the second crushing wall, a top wall assembly movable from a first open position to a second closed position, and a bottom wall movable from a first retain position to a second disposal position.

7. The container deposit return system of claim 1 wherein the crushing wall movement assembly comprises a linear actuator including at least one lead screw assembly and a motor rotatably coupled to the lead screw assembly.

8. The container deposit return system of claim 7 wherein the at least one lead screw assembly further includes a lead screw having a first end and a second end, with the first end being rotatably coupled to the motor, and rotatably coupled to one of the frame and the second crushing wall, and a second end, and with a lead nut fixedly coupled to the first crushing wall with the lead screw extending through the lead nut, whereupon rotation of the lead screw, the lead screw interfaces with the lead nut to translate the first crushing wall one of toward and away from the second crushing wall.

9. The container deposit return system of claim 7 wherein the at least one lead screw assembly comprises two lead screw assemblies, each positioned on opposing sides of the first crushing wall.

10. The container deposit return system of claim 1 wherein at least one of the first crushing wall and the second crushing wall includes an inclined lip at the lower end thereof.

11. The container deposit return system of claim 1 wherein the housing further comprises a frame having a base and a back wall upstanding from the base; and a cover, the cover having a top, a front, a first side and a second side, wherein the frame and the cover cooperatively define an inner cavity, with the crushing assembly being positioned therein, and wherein the top of the cover includes an access opening providing access to the crush cavity.

12. The container deposit return system of claim 1 further comprising a housing mount system.

13. The container deposit return system of claim 12 wherein the housing mount system further comprises a floor stand having a receiving platform, and a plurality of legs depending therefrom, collectively defining a lower cavity configured to receive a recycling tote.

14. The container deposit return system of claim 13 wherein the housing mount system further comprises a wall mount plate that is releasably securable to an outside wall and releasably securable to the housing to facilitate the mounting thereof to the outside wall.

15. A method of refunding a deposit on a container comprising the steps of:

providing a container deposit return system of claim 1;

establishing communication between a server and the can deposit return system;

receiving at the server an identification of the type of a container introduced into the container deposit return system;

receiving at the server an image of a container before crushing and an image of the container after crushing;

determining a match between the identification of the type of container and the image of the container before crushing and the image of the container after crushing; and refunding the deposit on the container if the step of determining determines a match.

16. The method of refunding of claim 15 further comprising the step of:

transmitting to the container deposit return system the identifications of acceptable ones of a type of container.

17. A method of utilizing a container deposit return system comprising the steps of:

providing a container deposit return system of claim 1;

placing the control system into communication with a server;

introducing a container into the crush cavity of the container deposit return system;

locking the crush cavity to preclude access thereto;

taking a first image of the container within the crush cavity prior to crushing of the container;

crushing the container within the crush cavity;

taking a second image of the container within the crush cavity after crushing of the container;

opening the crush cavity only after the steps of taking a first image, crushing the container and taking a second image;

transmitting the first image and the second image to the server; and removing the container from the crush cavity after the step of opening the crush cavity.

18. The method of claim 17 further comprising the steps of:

obtaining an identification of the container prior to taking the first image of the container;

comparing the identification of the container with a listing of known identifications to determine a match; and identifying one of a match and a no match to the user.

* * * * *